US005848539A

United States Patent [19]

Ouzounian

[11] Patent Number: 5,848,539

[45] Date of Patent: Dec. 15, 1998

[54] INVISIBLE PRECIOUS STONE SETTING AND METHOD THEREFOR

[75] Inventor: Vasken Ouzounian, Pasadena, Calif.

[73] Assignee: Gem Information Center, Inc., Los Angeles, Calif.

[21] Appl. No.: 828,435

[22] Filed: Mar. 28, 1997

[51] Int. Cl.[6] ..... A44C 17/02

[52] U.S. Cl. ..... 63/28; 63/15

[58] Field of Search ..... 63/15, 23, 26, 63/28, 32; 29/10, 896.412

[56] References Cited

U.S. PATENT DOCUMENTS

| | | | |
|---|---|---|---|
| 2,056,705 | 10/1936 | Arpels | 63/28 |
| 4,731,913 | 3/1988 | Plantureux et al. . | |
| 4,748,728 | 6/1988 | Magnien et al. . | |
| 4,835,987 | 6/1989 | Magnien et al. . | |
| 4,914,930 | 4/1990 | Bielka | 63/28 |
| 5,072,601 | 12/1991 | Slowinski . | |
| 5,099,660 | 3/1992 | Dostourian . | |
| 5,123,265 | 6/1992 | Ramot . | |
| 5,377,506 | 1/1995 | Tranzer . | |
| 5,423,196 | 6/1995 | Pollack . | |
| 5,548,976 | 8/1996 | Slowinski . | |
| 5,560,224 | 10/1996 | Tessler . | |
| 5,622,063 | 4/1997 | Slowinski | 63/28 |

*Primary Examiner*—Kien T. Nguyen

*Attorney, Agent, or Firm*—Thomas I. Rozsa; Tony D. Chen; Jerry Fong

[57] ABSTRACT

A ring has two zig-zag interior sidewalls and two opposite exterior sidewalls, where the walls form three parallel channels each receiving one of the rows of precious stones. Each interior sidewall has alternating inward and outward facing protruding projections extending into the channels, and each exterior sidewall has multiple small inward facing recesses. The alternative inward-facing protruding projections of one zig-zag sidewall are respectively paired with the alternative inward-facing protruding projections of the other zig-zag sidewall. The alternative outward-facing protruding projections of each zig-zag sidewall are paired with the small inward facing recesses of the respective adjacent exterior sidewall. The stones of the middle row have cutout grooves on both sides of each stone. The stones of the two outside rows have a cutout groove on only one side of each stone. The stones of the middle row are secured and held between the two zig-zag sidewalls, where the paired protruding flanges are engaged with the two cutout grooves at both sides of each stone. The stones of each outside row are secured and held between an interior sidewall and an adjacent exterior sidewall, where the outward-facing protruding projections of the interior sidewall are engaged with the cutout groove at one side of a respective stone, and the other side of the diamond without any cutout groove is engaged with the inward-facing dent of the exterior sidewall.

20 Claims, 5 Drawing Sheets

INVISIBLE PRECIOUS STONE SETTING AND METHOD THEREFOR

BACKGROUND OF THE INVENTION

1. Field of the Invention

The present invention generally relates to the field of jewelry design and manufacture. More particularly, the present invention relates to the field of jewelry settings and method of mounting precious stones therein, where the jewelry setting is substantially invisible.

2. Description of the Prior Art

Specifically, articles of jewelry in which multiple precious stones are mounted flush to one another with no spaces or setting material being visible, are very attractive and highly desirable. To invisibly mount a large number of princess cut diamonds (square shaped diamonds), one approach of the prior art is to notch the diamonds and to mount them in a setting which has two or more parallel flat-surfaced walls, with metallic projections, e.g., prongs or the like, protruding from the walls for interengaging the notches. Typically, these walls define channels in which the princess cut diamonds are set abutting one another in accordance with the invisible mounting method of the prior art. The disadvantage with this prior art invisible mounting method is that it is basically only suitable for princess cut diamonds but not for circular shaped diamonds.

Another approach of the prior art is to have sharp edges point upwardly from opposed facets of the diamonds. Because of the sharp edges, it is possible to push the diamonds down and secure the same in place between walls of the setting. The upwardly pointed edges tend to bite into the flat walls, such that an attempt to pull the diamonds out causes the upwardly pointed edges to bite deeper into the walls, thereby more securely fixing the diamond in place. The disadvantage with this prior art invisible mounting method is that it is also basically only suitable for princess cut diamonds but not for circular shaped diamonds.

The following ten (10) prior art patents are found to be pertinent to the field of the present invention:

1. U.S. Pat. No. 4,731,913 issued to Plantureux et al. on Mar. 22, 1988 for "Process For Making Jewelry Comprising One Or More Rows Of Stones And Jewelry Obtained By These Processes" (hereafter the "Plantureux Patent");
2. U.S. Pat. No. 4,748,728 issued to Magnien et al. on Jun. 7, 1988 for "Processes For Mechanized Manufacture Of Jewelry Comprising A Plurality Of Small Contiguous Stones Set In A Support Made Of Precious Metal Jewelry" (hereafter the "'728 Magnien Patent");
3. U.S. Pat. No. 4,835,987 issued to Magnien et al. on Jun. 6, 1989 for "Processes For Mechanized Manufacture Of Jewelry Comprising A Plurality Of Small Contiguous Stones Set In A Support Made Of Precious Metal, And Jewelry Obtained By These Processes" (hereafter the "'987 Magnien Patent");
4. U.S. Pat. No. 5,072,601 issued to Slowinski on Dec. 17, 1991 for "Diamond Setting" (hereafter the "'601 Slowinski Patent");
5. U.S. Pat. No. 5,099,660 issued to Dostourian on Mar. 31, 1992 for "Mounting For Gem Stones" (hereafter the "Dostourian Patent");
6. U.S. Pat. No. 5,123,265 issued to Ramot on Jun. 23, 1992 for "Invisible Gemstone Setting" (hereafter the "Ramot Patent");
7. U.S. Pat. No. 5,377,506 issued to Tranzer on Jan. 3, 1995 for "Gem Setting" (hereafter the "Tranzer Patent");
8. U.S. Pat. No. 5,423,196 issued to Pollack on June 13, 1995 for "Method Of Mounting Gems Flush To One Another In An Article Of Jewelry, And Articles Of Jewelry Produced By Such Method" (hereafter the "Pollack Patent");
9. U.S. Pat. No. 5,548,976 issued to Slowinski on Aug. 27, 1996 for "Precious Stone Mounting And Method Therefor" (hereafter the "'976 Slowinski Patent"); and
10. U.S. Pat. No. 5,560,224 issued to Tessler on Oct. 1, 1996 for "Jewelry Mounting Relatively Large Stones Higher Than Relatively Small Stones And Method Of Manufacture" (hereafter the "Tessler Patent").

The Plantureux Patent discloses a process for making jewelry comprising one or more rows of stones and jewelry obtained by these processes. It comprises a plurality of cylindrical conical housings, wherein each housing has an outer cylindrical bore and a conical seating.

The '728 Magnien Patent discloses a processes for mechanized manufacture of jewelry comprising a plurality of small contiguous stones set in a support made of precious metal jewelry.

The '987 Magnien Patent discloses a processes for mechanized manufacture of jewelry comprising a plurality of small contiguous stones set in a support made of precious metal, and jewelry obtained by these processes.

The '601 Slowinski Patent discloses a diamond setting. It has a matrix of invisibly mounted princess cut diamonds and cutouts located on the diamonds which are downwardly formed on the diamonds.

The Dostourian Patent discloses a mounting for gem stones. It comprises a plurality of large round diamonds and small round diamonds with the pavilion portion of the large round diamonds bearing directly upon and overlying a portion of the crown of the smaller round diamonds such that individually metal prongs for the diamonds are eliminated.

The Ramot Patent discloses an invisible setting for princess cut diamonds. It comprises grooves which are on the horizontal axis of the princess cut diamonds.

The Tranzer Patent relates to gem settings for jewelry made from noble metals for gems to be set over larger areas into large top bodies in a coherent arrangement wherein a plurality of small stones having a round top view configuration with a downwardly extending pointed end and a sharp peripheral edge are disposed in the top of the metal jewelry piece body snugly side by side, wherein the pointed ends of the gems are each inserted into corresponding open-bottom funnel-shaped setting recesses milled into the solid metal of the piece body, and wherein after inserted, the gems are held by prongs or the like which have been formed intermediately of the funnel-shaped setting recesses.

The Pollack Patent discloses a method of mounting gems such as princess cut diamonds flush to one another in an article of jewelry, and articles of jewelry produced by such method. It comprises locking grooves on the princess cut diamonds which are respectively inserted to holding ribs on the ring mount.

The '976 Slowinski Patent discloses a precious stone mounting and method therefor. A jewelry piece comprises an annular groove defined by spaced walls and a base. The groove is bordered by two upstanding rims and diamonds are placed in the groove in a row in abutting relationship.

The Tessler Patent discloses jewelry wherein relatively large stones are mounted higher than relatively small stones and a method of manufacturing this item.

It is highly desirable to have a very attractive and also very efficient design and construction of an article of jewelry, such as a ring or pendent, where a plurality of precious stones, such as round brilliant full cut diamonds are mounted flush to one another and with no gap between the diamonds to make the setting material invisible to the naked eye, thereby providing a uniform impression. It is further desirable to provide a method of mounting round precious stones, such as circular shaped diamonds, where the diamonds are more securely fixed within the setting, while the setting is substantially invisible.

SUMMARY OF THE INVENTION

The present invention is a method of and an apparatus for mounting two or more rows of round shaped precious stones, such as circular shaped diamonds, in a side-by-side manner on an article of jewelry, such as a ring, such that the precious stones are flush to one another without spaces or mounting material being visible therebetween.

In one preferred embodiment, the present invention method and apparatus is applied to a ring having three rows of circular shaped precious stones supported on a generally ring shaped mounting structure. The mounting structure includes a closed cavity, two spaced apart zig-zag parallel interior sidewalls extending the length of the cavity, and two opposite straight parallel exterior sidewalls, where the walls form three elongated parallel channels each receiving one of the rows of precious stones. Each interior sidewall has alternating inward and outward facing protruding projections or flanges extending into the channels, and each exterior sidewall has multiple spaced apart small inward-facing recesses or dents. The alternating inward-facing protruding projections of one zig-zag interior sidewall are respectively paired with the alternating inward-facing protruding projections of the other zig-zag interior sidewall in a spaced apart and oppositely facing relationship. The alternating outward-facing protruding projections of each zig-zag interior sidewall are paired with the small inward-facing recesses of the respective adjacent exterior sidewall and also in a spaced apart and oppositely facing relationship. The channels of the mounting structure are open at the top, but the alternating facing protruding flanges restrict the opening so that the precious stones cannot be directly inserted down into the channels without the application of a force.

The precious stones are formed with cutout grooves extending along both or either side of each precious stone. The stones of the middle row have cutout grooves on both sides of each stone. The stones of the two outside rows have a cutout groove on only one side of each stone. The precious stones of the middle row are secured and held between the two zig-zag interior sidewalls, where the paired alternating inward-facing protruding flanges are engaged with the two cutout grooves at both sides of each precious stone. The precious stones of each outside row are secured and held between an interior sidewall and an adjacent exterior sidewall, where the alternating outward-facing protruding projections of the interior sidewall are engaged with the cutout groove at one side of each stone, and the other side of the diamond without any cutout groove is engaged with the inward-facing dent of the adjacent exterior sidewall. What is unique about the method and apparatus of the present invention is that it can be used with circular shaped diamonds instead of square shaped diamonds as taught in the prior art. In addition, when the circular shaped diamonds are mounted within the cavity, the zig-zag interior sidewalls will be entirely concealed by the diamonds and no gaps between the diamonds are present. The mounting structure also provides a uniform top surface for the circular shaped diamonds, where the diamonds are flush with one another.

It is therefore an object of the present invention to provide a method and apparatus for mounting precious stones, particularly circular shaped diamonds, so that there are no spaces between the diamonds and such that the mounting material under the diamonds is invisible.

It is an additional object of the present invention to provide an apparatus which utilizes zig-zag interior sidewalls, where each zig-zag sidewall has alternating inward and outward facing protruding projections, and exterior sidewalls having multiple spaced apart small inward facing recesses for securing multiple rows of diamonds therebetween.

It is a further object of the present invention to provide a method of preparing precious stones, such as circular shaped diamonds, where the circular shaped diamonds have either one or two opposite cutout grooves.

It is still a further object of the present invention to provide a method of preparing precious stones, such as circular shaped diamonds, where the circular shaped diamonds have either one or two opposite V-shaped cutout grooves.

It is another object of the present invention to provide an apparatus which utilizes zig-zag interior sidewalls, where each zig-zag sidewall has alternating inward and outward protruding V-shaped projections, and exterior sidewalls having multiple spaced apart small inward facing recesses for securing multiple rows of diamonds therebetween.

The present invention is thus directed to increasing the aesthetic appeal of articles of jewelry which are composed of precious stones by decreasing impediments to light transmission between adjacent precious stones, and diamonds will also be more secured in the mounting.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
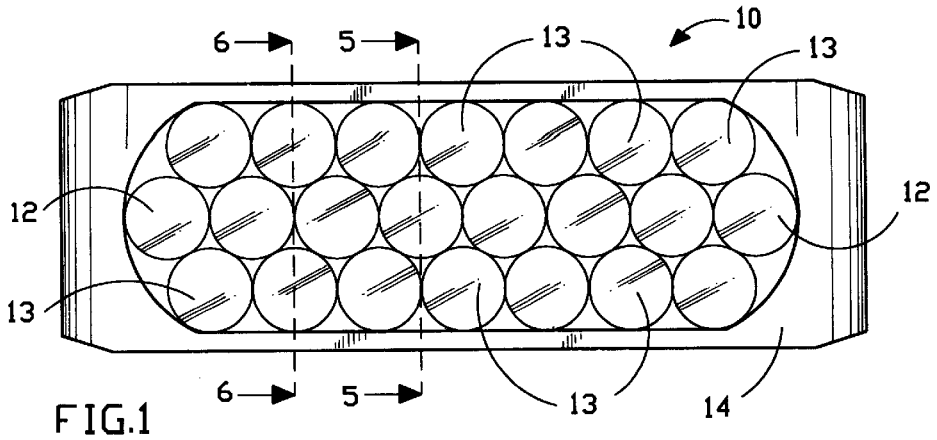
FIG. 1 is a top plan view of the present invention invisible precious stone setting for a ring.

Referring to FIG. 1, there is depicted at 10 a top plan view of a finished product of the present invention method and apparatus for mounting and setting two or more rows of precious stones, such as circular shaped diamonds, in an article of jewelry 14, such as a ring, such that the precious stones are flush to one another without spaces or mounting material being visible therebetween. The rows of precious stones include a middle row of diamonds 12 and two outside rows of diamonds 13.

Figure 8:
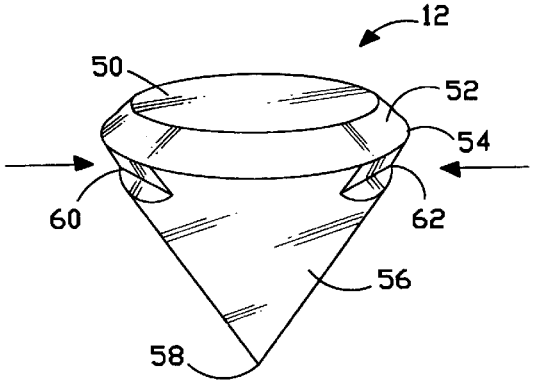
FIG. 8 is a perspective view of one of the circular shaped precious stones in the middle row, which has been prepared for being set in accordance with the method of and an apparatus of the present invention.
Figure 9:
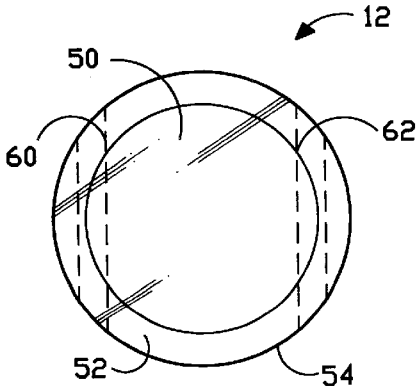
FIG. 9 is a top plan view of the circular shaped precious stone shown in FIG. 8.

Referring to FIGS. 8 and 9, there is depicted one of the plurality of diamonds 12 for the middle row in accordance with the present invention. Because the diamonds 12 are constructed the same, only one will be described in detail below. The diamond 12 is typically circular shaped and has an upper table 50 at the upper end thereof, a crown 52, a girdle 54, a lower cone shaped pavilion 56, and a culet 58 at the bottom of the cone shaped pavilion 56. In accordance with the approach of the present invention, the diamond 12 is provided with two opposite cutout grooves 60 and 62 which are formed with the aid of an exceedingly thin, disk-shaped saw (not shown) which rotates at a very high speed and which is held horizontally parallel to the table 50. The saw is moved along the directions indicated by the arrows toward the diamond to form the grooves 60 and 62. Consequently, the size of the grooves may vary from diamond to diamond.

Figure 10:
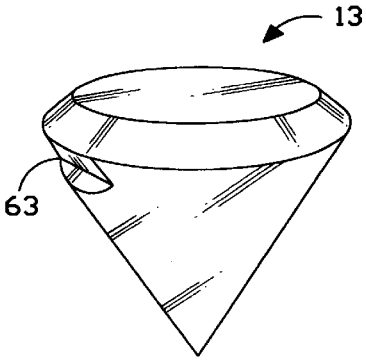
FIG. 10 is a perspective view of one of the circular shaped precious stones in the two outside rows, which has been prepared for being set in accordance with the method of and an apparatus of the present invention.

Referring to FIG. 10, there is depicted one of the plurality of diamonds 13 for the two outside rows in accordance with the present invention. Because the diamonds 13 are constructed the same as previously described above, the description thereof will not be repeated. The diamond 13 is typically the same as the diamond 12 shown in FIGS. 8 and 9 except that the diamond 13 only has one cutout groove 63 along one side of the diamond.

Figure 2:
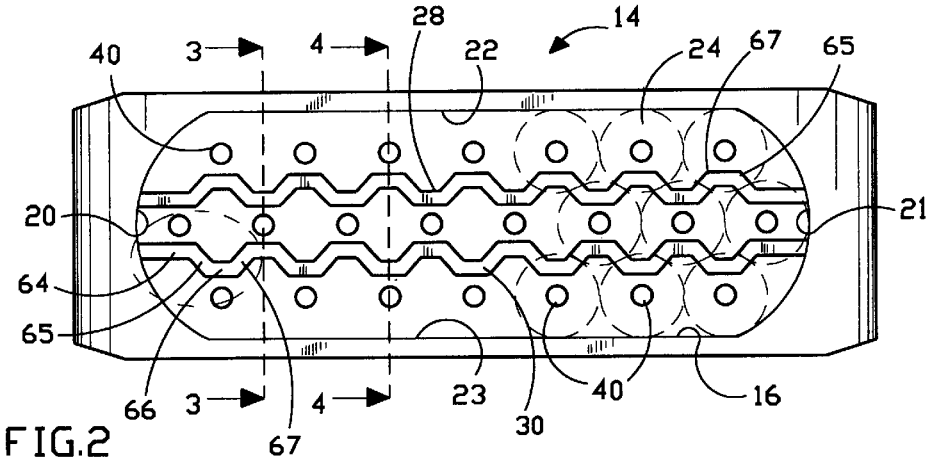
FIG. 2 is a top plan view of the preferred embodiment of a method and apparatus of the present invention, showing a ring application.
Figure 3:
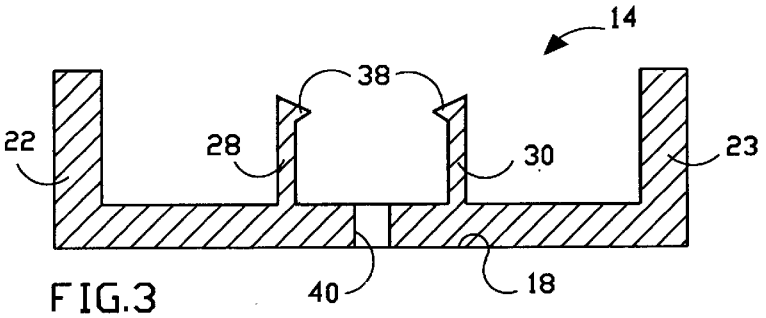
FIG. 3 is an enlarged cross-sectional view taken along line 3—3 of FIG. 2.
Figure 4:
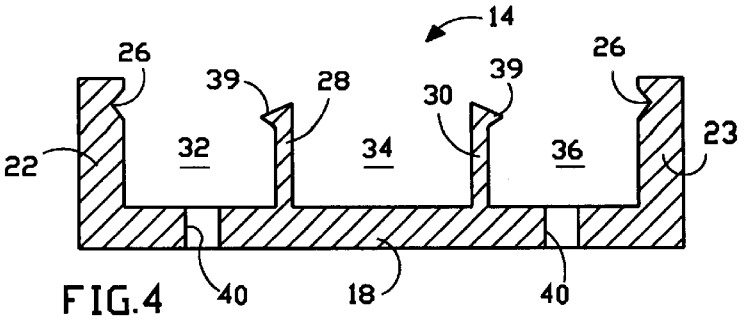
FIG. 4 is an enlarged cross-sectional view taken along line 4—4 of FIG. 2.

Referring to FIGS. 2, 3 and 4, there is shown the ring 14 which has a mounting structure 16. The mounting structure 16 includes a base portion 18, two opposite end walls 20 and 21, and two opposite exterior sidewalls 22 and 23. The walls 20, 21, 22, and 23 are integrally formed with the base portion 18 and extend upwardly from the base portion 18 to form a generally rectangular shaped cavity 24. Each exterior sidewall has a plurality of spaced apart small inward-facing recesses or dents 26 formed therein (see FIGS. 4 and 6).

Two spaced apart zig-zag interior sidewalls 28 and 30 are provided with the mounting structure 16. The two interior sidewalls 28 and 30 are mounted within the cavity 24, and integrally formed with the base portion 18 and the two opposite end walls 20 and 21. The two interior sidewalls 28 and 30 extend upwardly from the base portion to form three generally longitudinal channels 32, 34 and 36, where each channel receives therein one row of precious stones 12 and 13. The zig-zag sidewalls 28 and 30 in accordance with the present invention preferably extend longitudinally in the circumferential direction of the ring 14.

From the left of FIG. 2 where the portion of the zig-zag interior sidewall 30 is enclosed by dashed lines, each zig-zag sidewall is constructed with a first inward-facing longitudinal section 64 connected to an outward-facing bend section 65 which in turn connects to an outward-facing longitudinal section 66 which in turn connects to an inward-facing bend section 67, and etc., where the sections repeat itself starting with the inward-facing longitudinal section 64. A plurality of laterally alternating inward and outward facing protruding projections or flanges 38 and 39 respectively are integrally form on the longitudinal sections of the interior sidewalls 28 and 30, and located adjacent to the upper free ends. These alternating inward and outward facing projections 38 and 39 extend into the channels 32, 34 and 36 respectively (see FIGS. 3, 4, 5 and 6). In addition, these alternating inward and outward facing projections 38 and 39 may extend only a small portion on the longitudinal section.

Referring to FIG. 3, the alternating inward-facing protruding projections 38 of one zig-zag interior sidewall 28 are paired with the alternating inward-facing protruding projections 38 of the other zig-zag interior sidewall 30 in a spaced apart and oppositely facing relationship respectively. Referring to FIG. 4, the alternating outward-facing protruding projections 39 of each zig-zag interior sidewall are paired with the small inward-facing recesses 26 of a respective adjacent exterior sidewall and also in a spaced apart and oppositely facing relationship.

Figure 5:
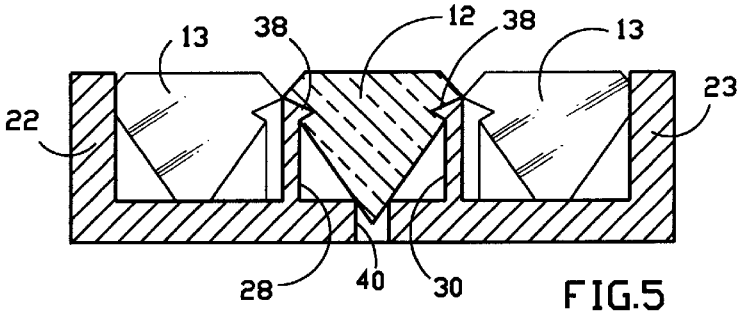
FIG. 5 is an enlarged cross-sectional view taken along line 5—5 of FIG. 1.
Figure 6:
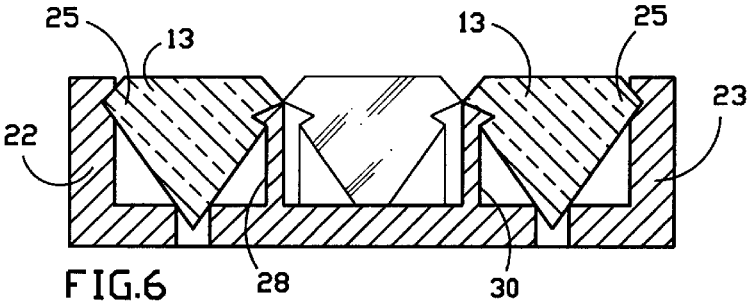
FIG. 6 is an enlarged cross-sectional view taken along line 6—6 of FIG. 1.
Figure 7:
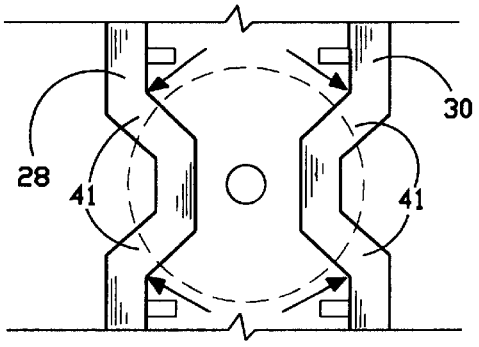
FIG. 7 is a partial enlarged top plan view of the zig-zag interior sidewalls holding a diamond therein.

As may be appreciated from FIGS. 5 and 6, the distance between the zig-zag interior sidewalls 28 and 30 is slightly smaller than the outer diameter of the diamond 12. The distance between one of the exterior sidewalls and one of the interior sidewalls is also slightly smaller than the outer diameter of the outside diamond 13. The thickness of the interior sidewalls 28 and 30 is such that when the diamonds are respectively inserted into the channels 32, 34 and 36, they are disposed very closely and, ideally, perfectly abutting one another as shown in FIG. 1. Referring to FIGS. 5 and 8, there is depicted one of the plurality of diamonds 12 for the middle row, which is mounted between the two zig-zag interior sidewalls 28 and 30. The diamond 12 is forced between the two zig-zag interior sidewalls 28 and 30, such that the paired alternating inward-facing protruding projections 38 are inserted and engaged with the two cutout grooves 60 and 62 at both sides of each diamond 12. Referring to FIG. 7, after the diamond is set therein, the paired alternating inward-facing protruding projections 38 of the zig-zag sidewalls 28 and 30 may be respectively forced inwardly to secure the diamond from moving in the transverse direction. In addition, the angled or inclined sections 41 of the zig-zag interior sidewalls 28 and 30 are tapped inwardly toward the diamond (shown by arrows) to create bulges at four locations such that these bulges prevent the diamond from moving in the longitudinal direction. Alternatively, small stopper bars or blocks may be placed at the locations indicated by the arrows, which can be tapped towards the diamond after the diamond is set to prevent the movement of the diamond.

Referring to FIGS. 4, 6 and 10, there is depicted two of the diamonds 13 for the two outside rows. The diamond 13 is secured and held between an interior sidewall and an adjacent exterior sidewall, where the outward-facing protruding projection 39 of the interior sidewall is engaged with the cutout groove 63 at one side of each diamond 13, and the other side 25 of the diamond 13 without any cutout groove is engaged with the inward-facing dent 26 of the adjacent exterior sidewall. After the diamond is set therein, the alternating outward-facing protruding projection 39 may be forced inwardly toward the diamond to secure the diamond in the transverse direction. In addition, the bend sections 65 and 67 of the zig-zag interior sidewalls 28 and 30 are tapped inwardly toward the diamond to create bulges at two opposite locations such that these bulges prevent the diamond from moving in the longitudinal direction (see FIG. 2).

Referring again to FIG. 2, the reference numeral 40 designates a plurality of spaced apart apertures on the base portion 18, which typically are circular shaped, and which are formed in the mounting structure 16 directly below the culet 58 of the diamonds 12 and 13, to admit light into the channels 32, 34 and 36, and thus enhance the lustre and light dispersing properties of the diamonds.

Figure 11:
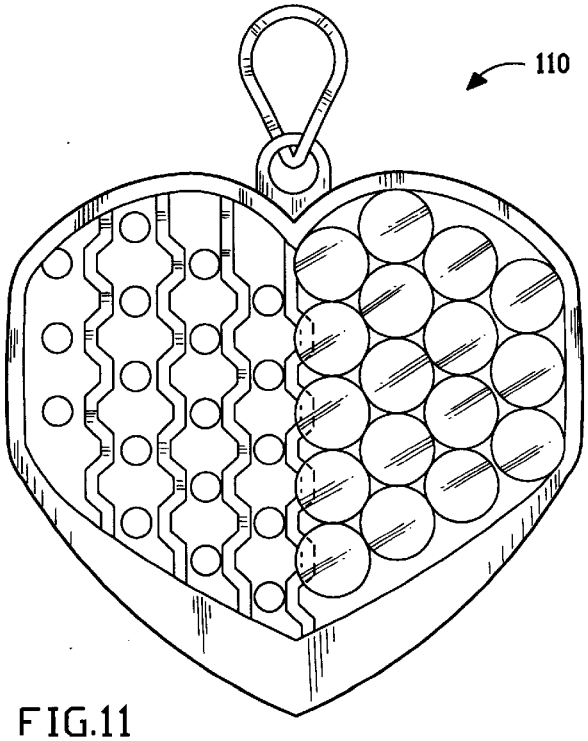
FIG. 11 is a top plan view of another application of an article of jewelry showing a heart shaped pendent structure in accordance with the method of and an apparatus of the present invention.

The present invention has been described in connection with a setting for a ring which produces a matrix of invisibly mounted diamonds. It will be appreciated that the method and apparatus of the present invention is not limited to the ring application as illustrated in FIGS. 1 and 2. It is emphasized that while the ring application is the preferred embodiment, it is also within the spirit and scope of the present invention to utilize the application for other jewelry articles including but not limited to necklaces and bracelets, bangels, earrings, and pendents. An example of such an application is a heart shaped pendent structure 110 as shown in FIG. 11. The mounting of the diamonds is the same as in the preceding embodiment, and the description thereof will not be repeated.

The present invention conforms to conventional forms of manufacture or any other conventional way known to one skilled in the art.

The present invention has many advantageous features including: (a) mounting of circular shaped precious stones; (b) mounting material being invisible; and (c) the diamonds having an uniform surface and are flush to one another and with no gap between the diamonds; and (d) more secured setting of diamonds.

Figure 12:
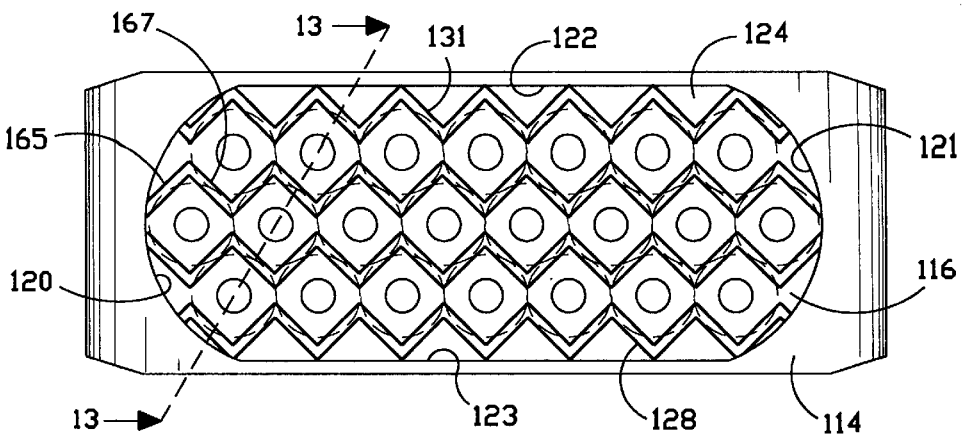
FIG. 12 is a top plan view of an alternative embodiment of a method of and an apparatus of the present invention, showing a ring application.

Referring to FIG. 12, there is depicted an alternative embodiment of the present invention method and apparatus for mounting two or more rows of precious stones, such as circular shaped diamonds, in an article of jewelry 114, such as a ring, such that the precious stones are flush to one another without spaces or mounting material being visible.

Figure 17:
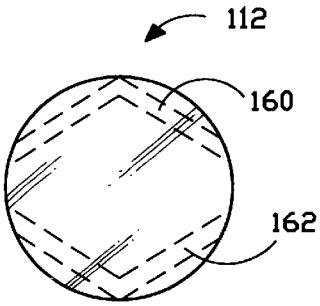
FIG. 17 is a perspective view of one of the circular shaped precious stones, which has been prepared for being set in accordance with the method of and an apparatus of the present invention.

Referring to FIG. 17, there is depicted a top plan view of one of the plurality of diamonds 112 in accordance with the present invention. Because the diamonds 112 are the same in the preceding embodiment, the description thereof will not be repeated, and only the modified part will be described in detailed. In this embodiment, cutout grooves 160 and 162 are generally V-shaped which are shown in dashed lines.

Figure 13:
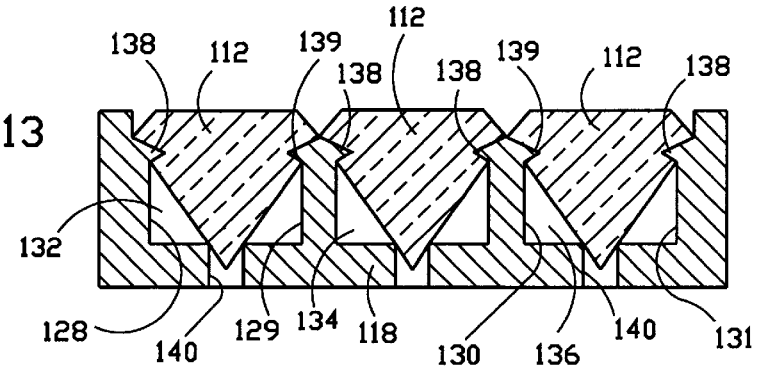
FIG. 13 is an enlarged cross-sectional view taken along line 13—13 of FIG. 12.

Referring to FIGS. 12 and 13, there is shown the ring 114 which has a mounting structure 116. The mounting structure 116 includes a base portion 118, two opposite end walls 120 and 121, and two opposite exterior sidewalls 122 and 123. The walls 120, 121, 122, and 123 are integrally formed with the base portion 118 and extend upwardly from the base portion 118 to form a generally rectangular shaped cavity 124.

Four spaced apart zig-zag interior sidewalls 128, 129, 130 and 131 are provided with the mounting structure 116. The zig-zag interior sidewalls 128, 129, 130 and 131 are mounted within the cavity 124, and integrally formed with the base portion 118 and the two opposite end walls 120 and 121. The zig-zag interior sidewalls extend upwardly from the base portion 118 to form three generally longitudinal channels 132, 134 and 136, where each channel receives a row of precious stones 112, all being flush with one another. The zig-zag interior sidewalls in accordance with the present invention preferably extend longitudinally in the circumferential direction of the ring 114.

From the left of FIG. 12, each zig-zag sidewall is constructed by a first outward bend section 165 which in turn connects to a second inward bend section 167 and etc., where the sections repeat itself starting with the outward bend section 165. Each bend section has protruding projections or flanges 138 and 139 which are integrally form thereto or it may only have one protruding projection 138. These protruding projections 138 and 139 are located adjacent to the upper free ends. These projections 138 and 139 extend into the channels 132, 134 and 136 respectively (see FIGS. 13). In addition, the projections 138 and 139 may extend only a small portion of the bend section.

Referring to FIGS. 13 and 17, the diamonds 112 are forced between two adjacent zig-zag interior sidewalls such that the protruding projections 138 and 139 are respectively inserted and engaged within the two V-shaped cutout grooves 160 and 162 of the diamond 112. After the diamond is set therein, the protruding projections 138 and 139 of the two adjacent zig-zag interior sidewalls may be respectively forced inwardly to secure the diamond from moving in the transverse and longitudinal directions.

The reference numeral 140 designates a plurality of spaced apart apertures on the base portion 118, which typically are circular shaped, and which are formed in the mounting structure 116 directly below the culet of the diamonds 112, to admit light into the channels 132, 134 and 136, and thus enhance the lustre and light dispersing properties of the diamonds.

Figure 14:
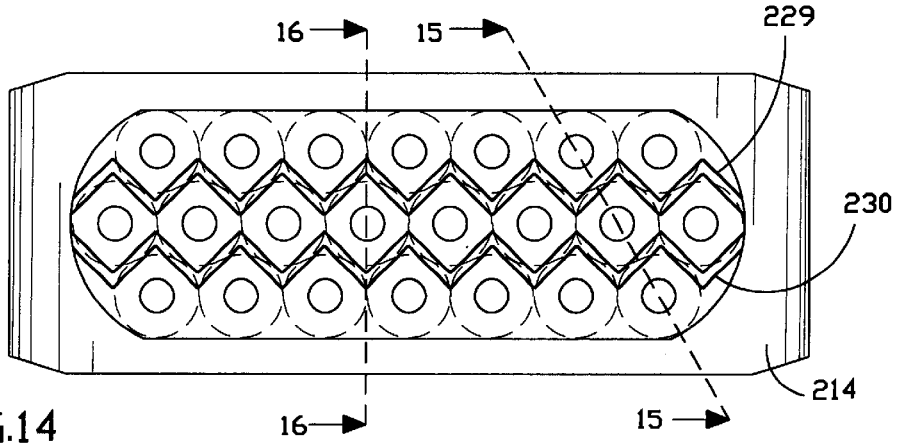
FIG. 14 is a top plan view of another alternative embodiment of a method of and an apparatus of the present invention, showing a ring application.

Referring to FIG. 14, there is depicted a top plan view of another alternative embodiment of the present invention method and apparatus for mounting two or more rows of precious stones, such as circular shaped diamonds, in an article of jewelry 214, such as a ring, such that the precious stones are flush to one another without spaces or mounting material being visible. It assembles and functions the same as described in FIGS. 12 and 13, except that the four zig-zag interior sidewalls 128, 129, 130 and 131 are substituted with only two space apart zig-zag interior sidewalls 229 and 230. The circular shaped diamond 112 shown in FIG. 17 is also used in this embodiment, and the description thereof will be repeated.

Referring to FIGS. 14 and 17, the diamonds 112 are formed with two opposite V-shaped cutout grooves on both or either side of each diamond. The diamonds of the middle row have V-shaped cutout grooves 160 and 162 on both sides of each stone. The diamonds of the two outside rows have only one V-shaped cutout groove on only one side of each diamond.

Figure 15:
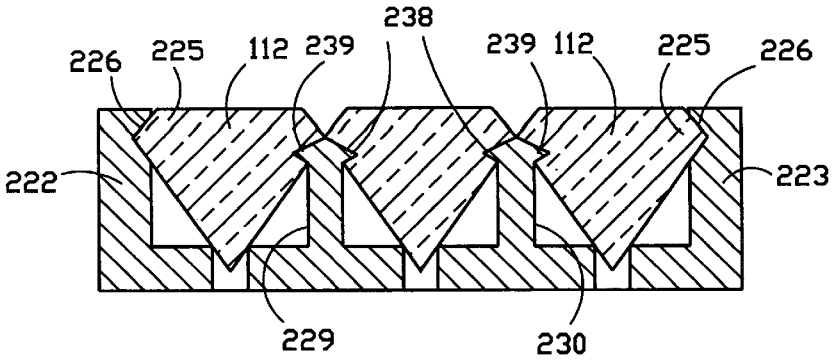
FIG. 15 is an enlarged cross-sectional view taken along line 15—15 of FIG. 14.
Figure 16:
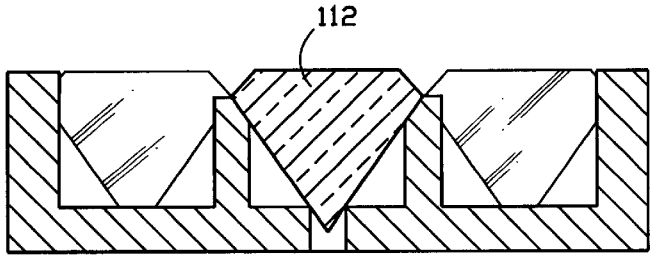
FIG. 16 is an enlarged cross-sectional view taken along line 15—15 of FIG. 14.

Referring to FIGS. 15 and 16, the diamonds 112 in the middle row are forced between the two interior zig-zag interior sidewalls 229 and 230, such that the protruding projections 238 are respectively inserted and engaged within the two V-shaped cutout grooves 160 and 162 of each diamond 112. After the diamond is set therein, the protruding projection 238 of the zig-zag sidewalls 229 and 230 may be respectively forced inwardly to secure the diamond thereto.

Referring to FIG. 15, the diamonds for the two outside rows has only one V-shaped cutout groove instead of two V-shaped cutout grooves as shown in FIG. 17. It will appreciated that the mounting of the outside diamond is the same as described in FIGS. 1 through 11, except that in this embodiment V-shaped cutout groove is utilized instead of longitudinal cutout grooves. The outside diamond is mounted between a zig-zag interior sidewall and an adjacent exterior sidewall. The other side 225 of the diamond 112 without the V-shaped cutout groove 160 is inserted into and engaged with the inward-facing dent 226 of the exterior sidewall, while the protruding projection 239 is inserted into and engaged within the V-shaped cutout groove 160 of the diamond 112. After the diamond is set therein, the protruding projection 239 may be forced inwardly to secure the diamond thereto.

Figure 18:
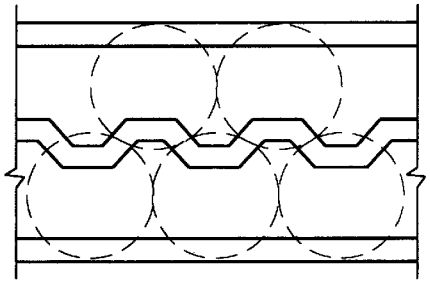
FIG. 18 is a partial top plan view of a further alternative embodiment of a method of and an apparatus of the present invention.
Figure 19:
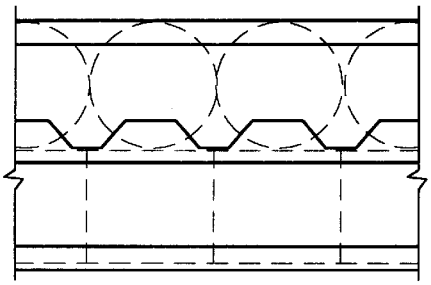
FIG. 19 is a partial top plan view of still another alternative embodiment of a method of and an apparatus of the present invention.

Referring to FIGS. 18 and 19, there are shown two possible alternative embodiments of the present invention. FIG. 18 shows two rows of circular diamonds mounted in a setting which has one middle zig-zag wall between two outer walls. FIG. 19 shows a row of circular diamonds mounted by utilizing a one-sided zig-zag wall together with a row of princess cut diamonds. The zig-zag wall on the circular diamond size has projections, while on the princess cut diamond side, it is straight with a straight groove.

Defined in detail, the present invention is a ring, comprising: (a) a mounting structure having a base portion, two opposite end walls, and two opposite exterior sidewalls, the walls integrally formed with the base portion and extending upwardly to form a cavity, each exterior sidewall having spaced apart inward-facing dents; (b) at least two spaced apart zig-zag interior sidewalls mounted within the cavity and integrally formed with the base portion and the two opposite end walls, and extending upwardly to form three longitudinal channels, each interior sidewall having alternating inward and outward facing protruding projections extending into a respective one of the three channels; (c) a plurality of middle circular shaped precious stones, each having an upper table, a lower pavilion, a girdle located between the table and the pavilion, and two opposite cutout grooves located on the pavilion and adjacent to the girdle, each middle precious stone respectively mounted between the at least two zig-zag interior sidewalls such that two opposite adjacent alternating inward-facing protruding projections are respectively inserted and engaged within the two cutout grooves of each middle precious stone; and (d) a plurality of outside circular shaped precious stones, each having an upper table, a lower pavilion, a girdle located between the table and the pavilion, and at least one cutout groove located on the pavilion and adjacent to the girdle, each outside precious stone respectively mounted between one of the two exterior sidewalls and one of the at least two interior sidewalls, such that the each dent on the each exterior sidewall receives the girdle of a respective one of the plurality of outside precious stones located in the adjacent channel and an opposite adjacent alternating outward-facing protruding projection is engaged with the cutout groove of at least one of the plurality of outside precious stones; (e) whereby the plurality of middle and outside precious stones all being flush with one another and the at least two spaced apart zig-zag interior sidewalls are hidden by the plurality of middle and outside precious stones.

Defined broadly, the present invention is a jewelry piece used in conjunction with a plurality of middle and outside circular shaped precious stones, each middle precious stone having two cutout grooves, and each outside precious stone having at least one cutout groove, the jewelry piece comprising: (a) a mounting structure having a base portion, two opposite end walls, and two opposite sidewalls, the walls integrally formed with the base portion and extending upwardly to form a cavity, each sidewall having inward-facing dents; and (b) at least two zig-zag sidewalls mounted within the cavity and integrally formed with the base portion and the two opposite end walls, and extending upwardly to form three channels, each zig-zag sidewall having alternating inward and outward protruding ribs, where the each middle precious stone is respectively mounted between the at least two zig-zag sidewalls such that two opposite adjacent alternating inward-facing protruding ribs are respectively inserted and engaged within the two cutout grooves of the each middle precious stone, and the each outside precious stone is respectively mounted between one of the two sidewalls and one of the two zig-zag sidewalls, such that the each dent on the each sidewall receives an opposite side of a respective one of the plurality of outside precious stones located in the adjacent channel and an opposite adjacent alternating outward-facing protruding rib is engaged with the cutout groove of at least one outside precious stone; (c) whereby the plurality of precious stones all being flush with one another and the at least two zig-zag sidewalls are hidden by the plurality of precious stones.

Defined alternatively in detail, the present invention is a ring, comprising: (a) a mounting structure having a base portion, two opposite end walls, and two opposite exterior sidewalls, the walls integrally formed with the base portion and extending upwardly to form a generally rectangular shaped cavity, each exterior sidewall having spaced apart inward-facing dents; (b) at least two spaced apart zig-zag interior sidewalls mounted within the cavity and integrally formed with the base portion and the two opposite end walls, and extending upwardly to form three longitudinal channels, each interior sidewall having a plurality of protruding projections extending into a respective one of the three channels; (c) a plurality of middle circular shaped precious stones, each having an upper table, a lower pavilion, a girdle located between the table and the pavilion, and two opposite V-shaped cutout grooves located on the pavilion and adjacent to the girdle, each middle precious stone respectively mounted between the at least two zig-zag interior sidewalls such that at least two opposite adjacent projections are respectively inserted and engaged within the two V-shaped cutout grooves of the each middle precious stone; and (d) a plurality of outside circular shaped precious stones, each having an upper table, a lower pavilion, a girdle located between the table and the pavilion, and a cutout groove located on the pavilion and adjacent to the girdle, each outside circular shaped precious stone respectively mounted between one of the two exterior sidewalls and one of the two interior sidewalls, such that the each dent of the each exterior sidewall receives the girdle of a respective one of the plurality of outside precious stones located in the adjacent channel and at least one opposite adjacent projection is engaged with the cutout groove of a respective outside precious stone; (e) whereby the plurality of middle and outside precious stones all being flush with one another.

Defined alternatively broadly, the present invention is a jewelry piece used in conjunction with a plurality of circular shaped middle and outside precious stones, each middle stone having two V-shaped cutout grooves, and each outside stone having at least one V-shaped cutout groove, the jewelry piece comprising: (a) a mounting structure having a base portion, two opposite end walls, and two opposite sidewalls, the walls integrally formed with the base portion and extending upwardly to form a cavity, each sidewall having inward-facing dents; and (b) at least two spaced apart zig-zag sidewalls mounted within the cavity and integrally formed with the base portion and the two opposite end walls, and extending upwardly to form three channels, each zig-zag sidewall having projections, where the each middle precious stone is respectively mounted between the at two zig-zag sidewalls such that at least two opposite adjacent projections are respectively inserted and engaged within the two V-shaped cutout grooves of the each middle precious stone, and the each outside precious stone respectively mounted between one of the two sidewalls and one of the two zig-zag sidewalls, such that the each dent on the each sidewall of the mounting structure receives an opposite side of a respective one of the plurality of outside precious stones located in the adjacent channel and at least one opposite adjacent projection is engaged with the at least one V-shaped cutout groove of a respective one of the outside precious stones; (c) whereby the plurality of precious stones all are flush with one another.

Defined more broadly, the present invention is a jewelry piece used in conjunction with a plurality of stones, each stone having at least one groove, the jewelry piece comprising: (a) at least one zig-zag wall located within a mounting structure, the zig-zag wall having a plurality of projections; and (b) each the stone is respectively mounted within the mounting structure, such that each projection of the at least one zig-zag wall is engaged with the groove of a respective one of the stones; (c) whereby the plurality of stones all being flush with one another and the at least one zig-zag wall is hidden by the plurality of stones.

Further defined alternatively in detail, the present invention is a method for setting a plurality of circular shaped precious stones in a ring such that the precious stones are flush with one another and with generally no space or setting material visible between them, the method comprising the steps of: (a) providing a mounting structure having a base portion, two opposite end walls, and two opposite exterior sidewalls, the walls integrally formed with the base portion and extending upwardly to form a cavity, each exterior sidewall having spaced apart inward-facing dents; (b) integrally forming at least two spaced apart zig-zag interior sidewalls with the base portion and the two opposite end walls, each zig-zag interior sidewall having alternating sets of inclined, horizontal and inclined walls with one horizontal wall facing outwardly toward the other sidewall and the adjacent horizontal wall facing inwardly toward an adjacent horizontal wall of the other zig-zag interior sidewall, and extending upwardly to form three longitudinal channels, each outwardly facing horizontal wall portion of each zig-zag interior sidewall having a respective outwardly facing protruding projection and each inwardly facing horizontal wall portion of each zig-zag interior sidewall having a respective inwardly facing protruding projection, each protruding projection each projection extending into a respective one of the three channels; (c) providing a plurality of middle circular shaped precious stones, each having an upper table, a lower pavilion, and a girdle located between the table and the pavilion; (d) cutting two opposite cutout grooves located on the pavilion and adjacent to the girdle of the each middle precious stone; (e) respectively mounting the each middle precious stone between the at least two zig-zag interior sidewalls such that two opposite adjacent alternating inward-facing projections are respectively inserted and engaged within the two cutout grooves of the each middle precious stone for preventing transverse movement; (f) tapping inclined sections of the at least two zig-zag interior sidewalls toward the each middle diamond for preventing longitudinal movement; (g) providing a plurality of outside circular shaped precious stones, each having an upper table, a lower pavilion, and a girdle located between the table and the pavilion; (h) cutting at least one cutout groove located on the pavilion and adjacent to the girdle of the each outside precious stone; (i) respectively mounting the each outside precious stone between one of the two exterior sidewalls and one of the two interior sidewalls, such that the each dent on the each exterior sidewall receives the girdle of a respective one of the plurality of outside precious stones located in the adjacent channel and an opposite adjacent alternating outward-facing projection is engaged with the cutout groove of at least one of each of the plurality of outside precious stones for preventing transverse movement; and (j) tapping the inclined sections of the at least two zig-zag interior sidewalls respectively toward the each outside diamond for preventing longitudinal movement; (k) whereby the plurality of middle and outside precious stones all being flush with one another and the at least two spaced apart zig-zag interior sidewalls are hidden by the plurality of middle and outside precious stones.

Further defined alternatively broadly, the present invention is a method of setting a plurality of middle and outside circular shaped stones in an article of jewelry such that the plurality of middle and outside stones are flush with one another and with generally no space or setting material visible between them, the method comprising the steps of: (a) providing a mounting structure having two exterior walls, each wall having inward-facing dents; (b) mounting at least two zig-zag inclined walls located between the two exterior walls and mounted within the mounting structure, each zig-zag inclined wall having alternating inward and outward facing projections; (c) cutting two cutout grooves on each of the plurality of middle stones; (d) respectively inserting the each middle stone between the at least two zig-zag walls such that two opposite adjacent alternating inward-facing projections are respectively inserted and engaged within the two cutout grooves of the each middle stone for preventing transverse movement; (e) tapping portions of inclined sections of the at least two zig-zag walls toward the each middle precious such that it forms bugles for preventing longitudinal movement; (f) cutting at least one cutout groove on each of the plurality of outside stones; and (g) respectively inserting the each outside stone between one of the two exterior walls and one of the at least two zig-zag walls, such that the each inward-facing dent on the each exterior wall receives an opposite side of a respective one of the plurality of outside stones located in the adjacent channel and an opposite adjacent alternating outward-facing projection is engaged with the cutout groove of at least one of each of the plurality of outside stones.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A ring, comprising:

a. a mounting structure having a base portion, two opposite end walls, and two opposite exterior sidewalls, the walls integrally formed with the base portion and extending upwardly to form a cavity, each exterior sidewall having spaced apart inward-facing dents;

b. at least two spaced apart zig-zag interior sidewalls mounted within said cavity and integrally formed with said base portion and said two opposite end walls, and extending upwardly to form three longitudinal channels, each interior sidewall having alternating inward and outward facing protruding projections extending into a respective one of the three channels;

c. a plurality of middle circular shaped precious stones, each having an upper table, a lower pavilion, a girdle located between the table and the pavilion, and two opposite cutout grooves located on the pavilion and adjacent to the girdle, each middle precious stone respectively mounted between said at least two zig-zag interior sidewalls such that two opposite adjacent alternating inward-facing protruding projections are respectively inserted and engaged within the two cutout grooves of each middle precious stone; and d. a plurality of outside circular shaped precious stones, each having an upper table, a lower pavilion, a girdle located between the table and the pavilion, and at least one cutout groove located on the pavilion and adjacent to the girdle, each outside precious stone respectively mounted between one of said two exterior sidewalls and one of said at least two interior sidewalls, such that said each dent on said each exterior sidewall receives said girdle of a respective one of the plurality of outside precious stones located in the adjacent channel and an opposite adjacent alternating outward-facing protruding projection is engaged with the cutout groove of at least one of the plurality of outside precious stones;

e. whereby said plurality of middle and outside precious stones all being flush with one another and said at least two spaced apart zig-zag interior sidewalls are hidden by said plurality of middle and outside precious stones.

2. The ring in accordance with claim 1 wherein said base portion of said mounting structure includes a plurality of spaced apart apertures, where each aperture is respectively located underneath each of said plurality of middle and outside precious stones for admitting light into said channels.

3. The ring in accordance with claim 1 wherein said each zig-zag interior sidewall comprises alternating sets of inclined, horizontal and inclined walls, with one horizontal wall facing toward a respective one of said two opposite exterior sidewalls of said mounting structure and the adjacent horizontal wall facing opposite an adjacent horizontal wall of the opposite zig-zag interior sidewall, and the each one horizontal wall facing the respective one of said two opposite exterior sidewalls having an outwardly protruding projection and the each adjacent horizontal wall facing the opposite adjacent horizontal wall of the other opposite zig-zag interior sidewall having an inwardly protruding projection.

4. A jewelry piece used in conjunction with a plurality of middle and outside circular shaped precious stones, each middle precious stone having two cutout grooves, and each outside precious stone having at least one cutout groove, the jewelry piece comprising:

a. a mounting structure having a base portion, two opposite end walls, and two opposite sidewalls, the walls integrally formed with the base portion and extending upwardly to form a cavity, each sidewall having inward-facing dents; and b. at least two zig-zag sidewalls mounted within said cavity and integrally formed with said base portion and said two opposite end walls, and extending upwardly to form three channels, each zig-zag sidewall having alternating inward and outward protruding ribs, where two opposite adjacent alternating inward-facing protruding ribs are for respectively inserting and engaging with said two cutout grooves of said each middle precious stone, and said each dent on said each sidewall is for engaging an opposite side of a respective one of said plurality of outside precious stones located in the adjacent channel and an opposite adjacent alternating outward-facing protruding rib is for engaging with said at least one cutout groove of said respective one of said plurality of outside precious stones;

c. whereby said plurality of precious stones all being flush with one another and said at least two zig-zag sidewalls are hidden by said plurality of precious stones.

5. The jewelry piece in accordance with claim 4 wherein said base portion of said mounting structure includes spaced apart apertures, where each aperture is being respectively located underneath each of said plurality of precious stones for admitting light into said channels.

6. The jewelry piece in accordance with claim 4 wherein said each zig-zag sidewall comprises alternating sets of inclined, horizontal and inclined walls, with one horizontal wall facing toward a respective one of said two opposite sidewalls of said mounting structure and the adjacent horizontal wall facing opposite an adjacent horizontal wall of the opposite zig-zag sidewall and the each one horizontal wall facing the respective one of said two opposite sidewalls having an outwardly protruding rib and the each adjacent horizontal wall facing the opposite adjacent horizontal of the opposite zig-zag sidewall having an inwardly protruding rib.

7. The jewelry piece in accordance with claim 4 wherein said mounting structure is generally a ring shape.

8. The jewelry piece in accordance with claim 4 wherein said mounting structure is generally a heart shaped pendent.

9. A ring, comprising:

a. a mounting structure having a base portion, two opposite end walls, and two opposite exterior sidewalls, the walls integrally formed with the base portion and extending upwardly to form a generally rectangular shaped cavity, each exterior sidewall having spaced apart inward-facing dents;

b. at least two spaced apart zig-zag interior sidewalls mounted within said cavity and integrally formed with said base portion and said two opposite end walls, and extending upwardly to form three longitudinal channels, each interior sidewall having a plurality of protruding projections extending into a respective one of the three channels;

c. a plurality of middle circular shaped precious stones, each having an upper table, a lower pavilion, a girdle located between the table and the pavilion, and two opposite V-shaped cutout grooves located on the pavilion and adjacent to the girdle, each middle precious stone respectively mounted between said at least two zig-zag interior sidewalls such that at least two opposite adjacent projections are respectively inserted and engaged within the two V-shaped cutout grooves of said each middle precious stone; and d. a plurality of outside circular shaped precious stones, each having an upper table, a lower pavilion, a girdle located between the table and the pavilion, and a cutout groove located on the pavilion and adjacent to the girdle, each outside circular shaped precious stone respectively mounted between one of said two exterior sidewalls and one of said two interior sidewalls, such that said each dent of said each exterior sidewall receives said girdle of a respective one of the plurality of outside precious stones located in the adjacent channel and at least one opposite adjacent projection is engaged with said cutout groove of a respective outside precious stone;

e. whereby said plurality of middle and outside precious stones all being flush with one another.

10. The ring in accordance with claim 9 wherein said base portion of said mounting structure includes spaced apart apertures, where each aperture is respectively located underneath each of said plurality of middle and outside precious stones for admitting light into said channels.

11. The ring in accordance with claim 9 wherein said plurality of middle and outside precious stones include a diamond.

12. A jewelry piece used in conjunction with a plurality of circular shaped middle and outside precious stones, each middle stone having two V-shaped cutout grooves, and each outside stone having at least one V-shaped cutout groove, the jewelry piece comprising:

a. a mounting structure having a base portion, two opposite end walls, and two opposite sidewalls, the walls integrally formed with the base portion and extending upwardly to form a cavity, each sidewall having inward-facing dents; and b. at least two spaced apart zig-zag sidewalls mounted within said cavity and integrally formed with said base portion and said two opposite end walls, and extending upwardly to form three channels, each zig-zag sidewall having projections, where at least two opposite adjacent projections are for respectively inserting and engaging with said two V-shaped cutout grooves of said each middle precious stone, and said each dent on said each sidewall of said mounting structure is for receiving an opposite side of a respective one of said plurality of outside precious stones located in the adjacent channel and at least one opposite adjacent projection is for engaging with said at least one V-shaped cutout groove of a respective one of the outside precious stones;

c. whereby said plurality of precious stones all are flush with one another.

13. The jewelry piece in accordance with claim 12 wherein said base portion of said mounting structure includes spaced apart apertures, where each aperture is for being respectively located underneath each of said plurality of precious stones for admitting light into said channels.

14. The jewelry piece in accordance with claim 12 wherein said mounting structure is generally a ring shape.

15. The jewelry piece in accordance with claim 12 wherein said mounting structure is generally a heart shaped pendent.

16. A jewelry piece used in conjunction with a plurality of stones, each stone having at least one groove, the jewelry piece comprising:

a. at least one zig-zag wall located within a mounting structure, the at least one zig-zag wall having a plurality of projections, the mounting structure having spaced apart apertures where each aperture is being respectively located underneath each of said plurality of stones for admitting light; and b. said each projection of said at least one zig-zag wall is for engaging with said at least one groove of a respective one of the plurality of stones;

c. whereby said plurality of stones all being flush with one another and said at least one zig-zag wall is hidden by said plurality of stones.

17. The jewelry piece in accordance with claim 16 wherein said mounting structure is generally a ring shape.

18. The jewelry piece in accordance with claim 16 wherein said mounting structure is generally a heart shaped pendent.

19. A ring used in conjunction with a plurality of stones, each stone having at least one groove, the ring comprising:

a. at least one zig-zag wall located within a mounting structure and having a plurality of projections; and b. said each projection of said at least one zig-zag wall is for engaging with said at least one groove of a respective one of the plurality of stones;

c. whereby said plurality of stones all being flush with one another and said at least one zig-zag wall is hidden by said plurality of stones.

20. The jewelry piece in accordance with claim 19 wherein said mounting structure includes spaced apart apertures, where each aperture is being respectively located underneath each of said plurality of stones for admitting light.

* * * * *